United States Patent [19]

Clark

[11] Patent Number: 4,867,470

[45] Date of Patent: Sep. 19, 1989

[54] MONOSKI SYSTEM FOR SNOW

[75] Inventor: David B. Clark, Corpus Christi, Tex.

[73] Assignee: Sportech, Inc., Steamboat Springs, Colo.

[21] Appl. No.: 913,933

[22] Filed: Oct. 1, 1986

[51] Int. Cl.[4] ..... A63C 9/00

[52] U.S. Cl. ..... 280/611; 280/617; 441/70

[58] Field of Search ..... 280/607, 609, 611, 613, 280/614, 615, 617, 618; 441/70

[56] References Cited

U.S. PATENT DOCUMENTS

| | | | |
|---|---|---|---|
| 1,087,745 | 2/1914 | Ellis | 280/600 |
| 2,237,998 | 11/1939 | Neuhauser | 280/636 |
| 2,382,149 | 2/1944 | Hartman | 441/70 |
| 2,950,118 | 8/1960 | Sharpe | 280/11.14 |
| 3,056,148 | 10/1962 | Abbott et al. | 441/70 |
| 3,090,978 | 5/1963 | Hanson | 441/70 |
| 3,119,130 | 1/1964 | Senne et al. | 441/70 |
| 3,404,900 | 10/1968 | Rippetoe | 280/609 |
| 3,675,938 | 7/1972 | Sigl | 280/607 |
| 3,854,738 | 12/1974 | Fish | 280/607 |
| 3,900,204 | 8/1975 | Weber | 280/607 |
| 3,926,451 | 12/1975 | Guild | 280/609 |
| 3,929,344 | 12/1975 | Ott | 280/607 |
| 3,934,893 | 1/1976 | Greenleaf | 280/611 |
| 3,947,049 | 3/1976 | Pederson | 280/609 |
| 4,008,908 | 2/1977 | Pierson | 280/607 |
| 4,022,491 | 5/1977 | Powell | 280/607 |
| 4,028,760 | 6/1977 | Tarlton, Jr. | 280/607 |
| 4,211,433 | 7/1980 | Pederson | 280/609 |
| 4,275,904 | 6/1981 | Pederson | 280/818 |
| 4,294,460 | 10/1981 | Kirsch | 280/607 |
| 4,305,603 | 12/1981 | Müller et al. | 280/609 |

FOREIGN PATENT DOCUMENTS

| | | |
|---|---|---|
| 989435 | 9/1974 | Canada . |
| 2007366 | 2/1969 | Fed. Rep. of Germany . |
| 2723864 | 11/1978 | Fed. Rep. of Germany . |
| 2932935 | 3/1981 | Fed. Rep. of Germany . |
| 2446654 | 1/1979 | France . |
| 2543843 | 3/1983 | France . |

*Primary Examiner*—Charles A. Marmor
*Assistant Examiner*—Richard Camby
*Attorney, Agent, or Firm*—G. Turner Moller

[57] ABSTRACT

A monoski system includes a single ski having a conventional ski binding secured thereto and a boot receiver rearwardly of the ski binding. The boot receiver loosely receives the footwear of the skier and includes a boot supporting platform and a tapered section positioning the skier's rear boot in a forwardly inclined position. In one embodiment, the boot supporting platform is angularly adjustable about an upright axis to position the skier's rear boot at a small acute angle relative to the direction of intended travel. The inclination of the boot is adjustable by changing the tapered section.

12 Claims, 3 Drawing Sheets

MONOSKI SYSTEM FOR SNOW

This invention relates to ski equipment and more particularly to a single snow ski having means thereon for receiving both feet of the skier.

Conventional snow skis are used in pairs and each have attached thereto a binding mechanism which receives a single ski boot. The conventional skier does not travel straight down the mountain. Instead, the skier travels downwardly at an angle to the steepest gradient. The uphill ski is necessarily elevated slightly relative to the downhill ski and the experienced skier uses the edges of the skis to turn so that the path travelled down the mountain is more-or-less a zig-zag.

Because gravity propels the skier down the mountain, the skier must lean forwardly slightly to place the skier's center of gravity forwardly on the ski. If the skier leans backward on the skis, the skis slip forwardly and the skier abruptly sits down on the snow.

This is in marked contrast to a water skier. When water skiing, the skier must lean backwardly against the rope pulling the skier through the water. In this fashion, the skis are pushed across the surface of the water by a force transmitted from the rope through the body of the skier. If the water skier leans forwardly, the rope merely pulls the skier into the water over the front of the skis. Thus, snow and water skiing are entirely different techniques even though they may be superficially similar.

This invention relates to snow skiing by using a single ski. Such proposals have been made in the prior art as shown in U.S. Pat. Nos. 3,404,900; 3,854,738; 3,900,204; 3,929,344; 3,934,893; 3,947,049; 4,008,908; 4,022,491; 4,211,433; 4,275,904; and 4,305,603 as well as Canada patent No. 989,435; France patents Nos. 2,446,654; 2,455,907; and 2,543,843; West Germany patents Nos. 2,007,366; 27 33 864 and 29 32 935. Other disclosures of interest are found in U.S. Pat. Nos. 1,529,561; 2,237,998; 2,382,149; 2,950,118; 3,119,130; 3,090,978; and 4,028,760.

Upon analysis, it will be seen that there are a variety of different types of skis and binding arrangements used for skiing with a single ski. One of these types have the skier's feet side-by-side and essentially parallel. Another type is to have the skier's feet behind one another. There appear to be two subtypes of monoskis in which the feet are one behind the other: (1) those monoskis in which the skier's boots are secured to the ski in essentially the same manner that conventional skier's boots are secured to separate skis and (2) those monoskis in which the rearward boot is supported on but unsecured to the monoski. It is this latter type monoski which most nearly relates to the embodiments of this invention.

Monoskis of the type of this invention will initially be appealing to two distinctly different groups: (1) those skiers which are moderately advanced and beyond and (2) handicapped persons with one bad leg. Some of these people may have skied before suffering an accident or illness leaving one leg weak. Some of them may have suffered a childhood illness, like polio, and may have never skied before. Advanced skiers find monoskis of this invention challenging because skiing techniques are slightly different. Persons with one bad leg find that they can ski with monoskis of this invention because most of the skier's weight is supported by the skier's good leg while a good bit of the control is provided by the skier's bad leg. Because the skier has to have his center of gravity forwardly on the ski, the forward leg will be the good leg of the handicapped person, regardless of whether that leg is left or right.

A number of improvements to monoskis are introduced by this invention. The only two disclosures of monoskis of the subtype of this invention are found in U.S. Pat. Nos. 3,404,900 3,934,893 and 4,008,908. In both these devices, the forward foot is secured to the ski, on the axis thereof, by a more-or-less conventional binding. As will be more fully apparent hereinafter, most of the improvements of this invention relate to the technique by which the rear foot is supported on the monoski.

All embodiments of this invention provide a platform on which the skier's rear boot rests. The platform is inclined to the ski by a tapered or wedge shaped insert located between the platform and the ski. As one feature of the invention, the platform is angularly adjustable about a generally vertical axis relative to the ski to orient the rear foot at a small acute angle relative to the ski axis or the direction of travel. As another feature of the invention, the insert is secured to the ski by a relatively rigid, but slightly elastic, elastomeric connection to avoid transferring torsion and/or flex between the ski and the platform. A hood is provided on the forward end of the platform to receive the skier's rear boot therein. An inflatable bladder inside the hood may be blown up to provide support for the skier's boot as well as to provide insulation from the cold.

It is a primary object of this invention to provide an improved monoski system allowing a person to ski on snow.

Other objects and advantages of this invention will become more fully apparent as this description proceeds, reference being made to the accompanying drawings and appended claims.

Figure 10:
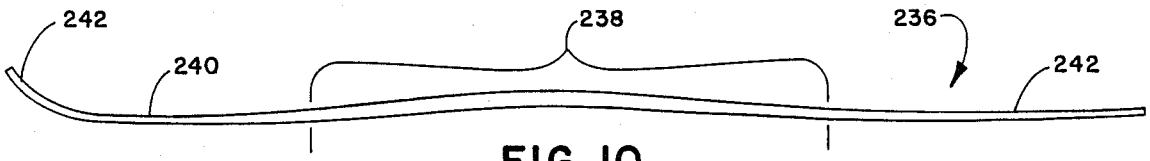
FIG. 10 is a side elevational view of a ski designed specifically for use with monoski type bindings and receivers.
Figure 2:
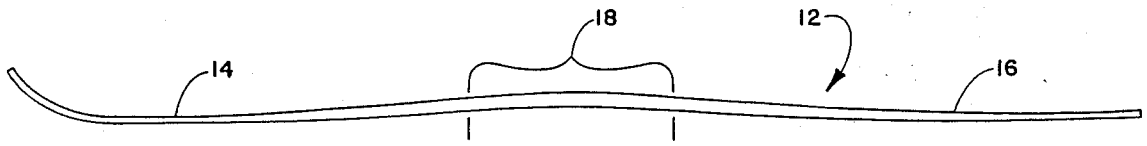
FIG. 2 is a side elevational view of the conventional snow ski illustrated in FIG. 1.
Figure 5:
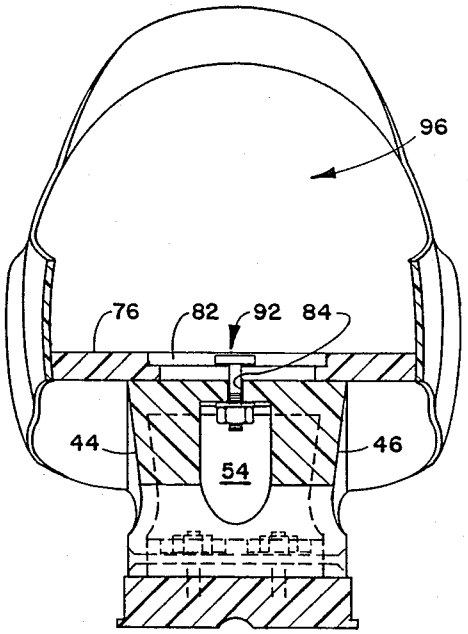
FIG. 5 is a cross-sectional view of the boot receiver of FIG. 4, taken substantially along line 5—5 thereof, as viewed in the direction indicated by the arrows.

Referring to FIGS. 1–5, there is illustrated a monoski system 10 allowing a person to ski on snow with only one ski. The system 10 includes a single ski 12 which may be of conventional design as shown best in FIGS. 1 and 2 or which may be of special design as shown in FIG. 10. The ski 12 includes a forward end 14, a rearward end 16 and boot binding area 18 therebetween. Attached to the ski 12 adjacent the forward end of the ski binding area 18 is a more-or-less conventional ski boot binding 20 which attaches the boot 22 of a skier to the ski 12 and which releases the boot 22 upon the application of a predetermined force between the boot 22 and the binding 20. As is apparent, the binding 20 positions the boot 22 so that it is pointed down the axis 24 of the ski 12 in the direction of intended travel.

Attached to the ski 12 rearwardly of the binding 20, either in the ski binding area 18 or to the rear thereof, is a boot receiver 26 of this invention. The boot receiver 26 of this invention comprises, as major components, a tapered or wedge shaped section 28, means 30 securing the tapered section 28 to the ski 12, a platform 32 for supportably receiving the boot or footwear of the skier, means 34 securing the tapered section 28 to the platform 32 and a hood 36 covering the forward part of the platform 32 and providing a cavity for receiving the foot of the skier.

The tapered section 28 is rigid and generally wedge shaped to elevate the heel of the skier and thereby naturally position the center of gravity of the skier forwardly on the ski 12. To this end, the forward portion 38 of the section 28 is considerably thinner than the rear portion 40. The tapered section 28 may be of any suitable design and preferably includes a generally planar upper surface 42 and solid depending spaced side walls 44, 46 on opposite sides of a central slot extending from front to rear of the boot receiver 26. The central slot is interrupted by a plurality of generally upright partitions 48, 50, 52, 54 to provide a plurality of downwardly facing cavities 56, 58, 60, 62, 64. This type construction is not only rigid and light weight but also provides location for the connecting means 30, 34 as will be more fully apparent hereinafter.

The connecting means 30 solidly secures the tapered section 28 to the ski 12 and preferably provides a slightly resilient connection between the ski 12 and the tapered section 28 to lessen the torsional and/or flexure forces transmitted to the boot receiver 26. In addition, the elasticity of the connecting means 30 reduces vibration transmitted through the tapered section 28 which makes skiing more comfortable to the skier. To these ends, the connecting means 30 comprises a block 66 of elastomeric material having a pair of openings in the center thereof receiving a pair of threaded studs 68. A washer 70 and nut 72 on each of the studs 68 captivates the block 66 to the ski 12. The block 66 connects to the tapered section 28 through a plurality of pins 74 extending through the side walls 44, 46 and through the elastomeric block 66. It will accordingly be seen that stresses imparted to the ski 12 are transmitted through the elastomeric connecting means 30 to the tapered section 28.

Figure 4:
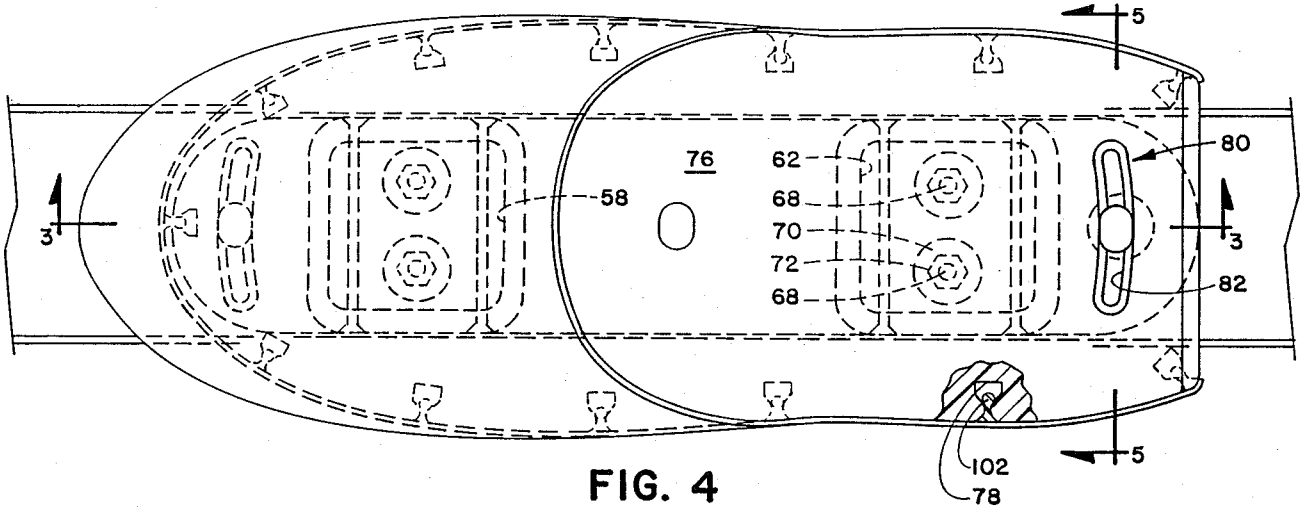
FIG. 4 is a top plan view of the boot receiver of FIG. 3.
Figure 3:
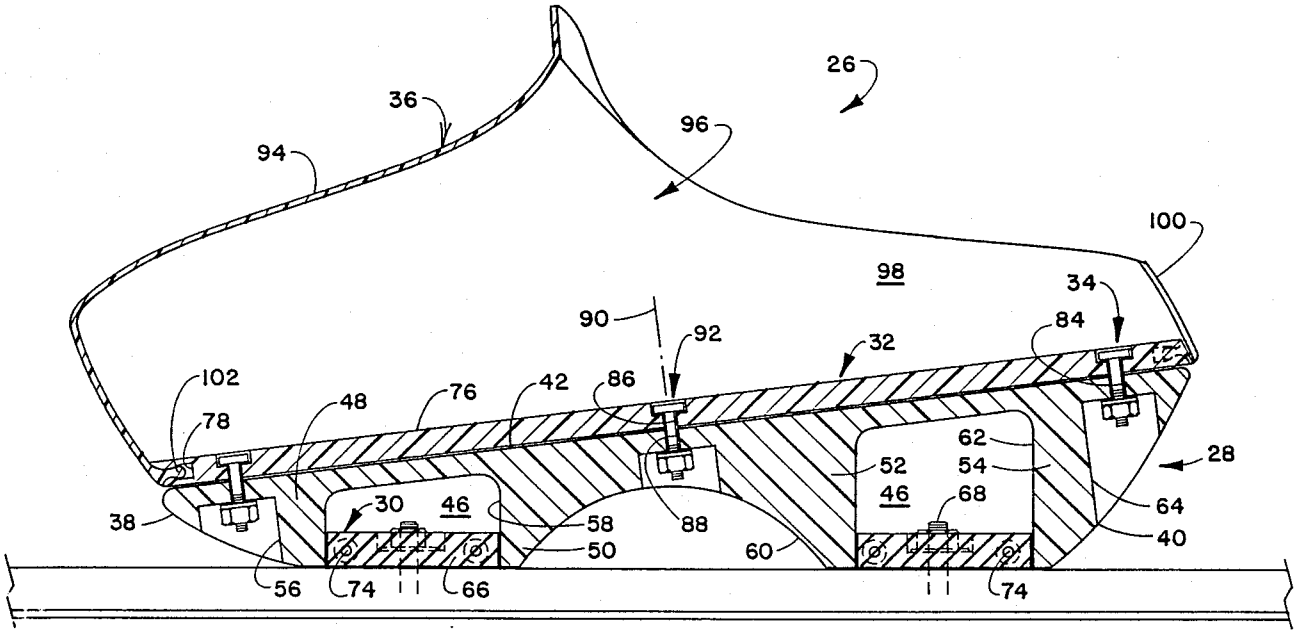
FIG. 3 is an enlarged longitudinal cross-sectional view of a rear boot receiver of this invention.

The platform 32 is made of a rigid material and comprises a planar upper surface 76 which :s preferably coated with an adhesive nonskid material. As shown in FIG. 4, the platform 32 is sufficiently long and broad to receive the footwear of the skier. The platform 32 may comprise the upper surface 42 of the tapered section but is preferably connected to the tapered section 28 by the connecting means 34 to allow the platform 32 to be angularly positioned relative to the tapered section 28. For purposes more fully pointed out hereinafter, the platform 32 provides a series of spaced blind apertures 78 extending about the forward end and sides thereof. The apertures 78 have a restricted neck adjacent the opening thereof.

The connecting means 34 comprises a plurality of cooperating slot and opening arrangements 80 provided by the platform 32 and tapered section 28. The arrangements 80 are illustrated to comprise slots 82 near the front and rear ends of the platform 32 and aligned openings 84 in the tapered section 28. A set of aligned openings 86, 88 near the center of the platform 32 defines an axis 90 of rotational adjustment. A series of threaded fasteners 92 are received in the arrangements 80 and in the aligned openings 86, 88. It will be evident that the slots 82 provide for a range of angular adjusting movement of the platform 32 about the axis 90. It will also be seen that the fasteners 92 can be tightened to position the platform 32 at any angular position within the limits provided by the slots 82.

The hood 36 is illustrated as being shaped much like the upper of a shoe and comprises a forward section 94 located over the forward end of the platform 32 providing a cavity 96 to receive the footwear of the skier. The hood 36 also includes sides 98 to restrain slight or minimal lateral movement of the skier's foot but provides an open heel 100 which provides little or no obstruction to the skier moving the rear foot rearwardly through the heel 100. The hood 36 is connected to the platform 32 by a series of peripherally spaced protuberances 102. In the event of a fall, it will be seen that the protuberances 102 can pull out of the apertures 78 to release the skier's foot in a lateral direction. It will accordingly be evident that the hood 36 does not restrain movement of the skier's foot in a forward direction to a degree that injury can result.

One of the features of this invention is that the tapered section 28 can be removed and replaced with a similar tapered section or sections having different inclinations or having different heights off the ski 12. In this fashion, considerable flexibility can be provided with little or no difficulty.

Skiing with the monoski system 10 of this invention should now be apparent. The skier places the dominant or strong leg in the forward ski binding 20 and then places the foot of the other leg in the receiver 26. By leaning forwardly, as assisted by the forward inclination of the tapered section 28, the skier moves down the slope. To turn, body weight is transferred through both legs and feet to the ski 12 in such a manner as to cause the ski 12 to carve arcs which alternately are concave to the skier's left and then immediately concave to the skier's right. The sensation of skiing on the single ski 12 using this method is substantially different than conventional skiing since both feet are controlling only one edge while, in conventional skiing, each edge is controlled by one foot. This technique of monoskiing provides much greater control than traditional skiing. The monoskier is able to carve deeper and longer arcs which heightens the enjoyment of the turning sensation.

Figure 6:
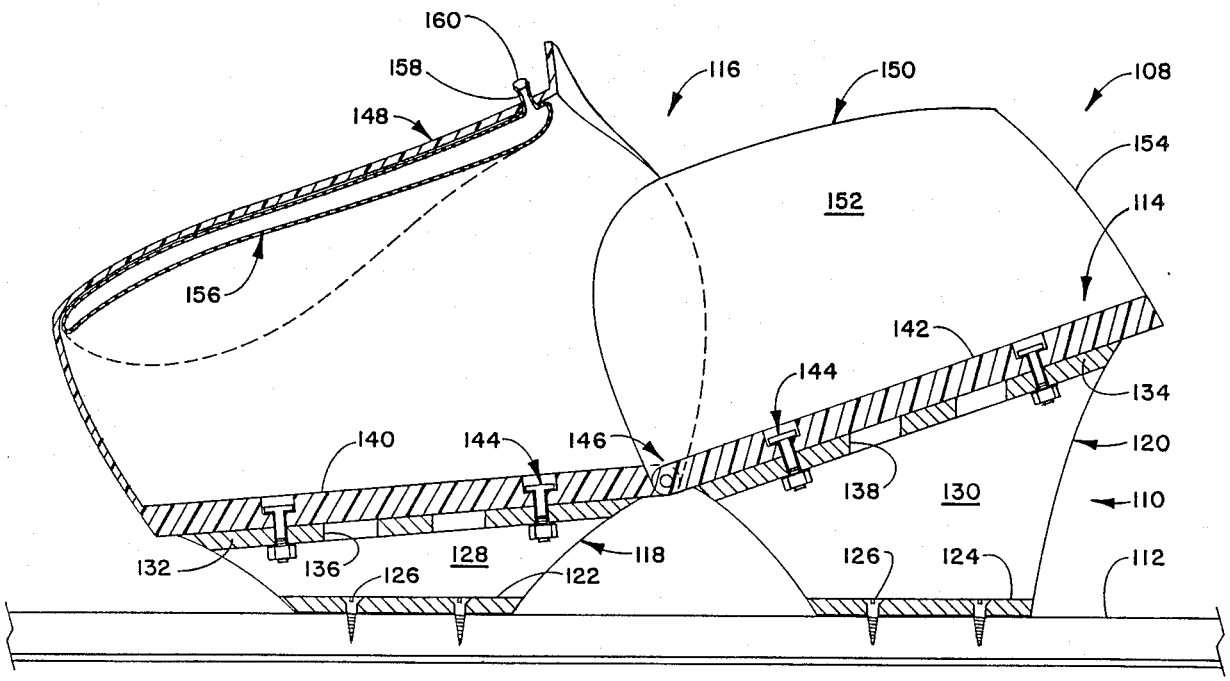
FIG. 6 is an enlarged longitudinal cross-sectional view of another embodiment of a rear boot receiver of this invention.

Referring to FIG. 6, another embodiment of this invention is illustrated. A boot receiver 108 is illustrated as including a tapered section 110 secured to a ski 112 behind a more-or-less conventional ski binding (not shown), a platform 114 secured to the tapered section 110 and a hood 116. The tapered section 110 comprises separate front and rear portions 118, 120 comprising a base 122, 124 rigidly secured to the ski 112 by suitable threaded fasteners 126. The tapered portions 118, 120 are generally box shaped having side walls 128, 130 and top walls 132, 134 which include openings 136, 138 providing access to the threaded fasteners 126.

The platform 114 comprises separate generally planar front and rear sections 140, 142 which incline in the same direction but at a different acute angle relative to the ski 112. The sections 140, 142 are connected to the top walls 132, 134 of the tapered section 110 by suitable threaded fasteners 144. Coupling the front and rear sections 140, 142 together is a hinge connection 146. The hinge connection 146 provides additional cohesiveness to the boot receiver 108 while allowing flexing of the ski 112.

The platform sections 140, 142 are desirably injection molded from organic polymeric materials. Preferably, the hood 116 is made as an integral part of the platform sections 140, 142 and is of the same material, only thinner. To this end, the hood 116 comprises a forward section 148 having the appearance of the forward portion of a shoe or boot and a rearward section 150 comprising a pair of upstanding side walls 152 and an open heel 154.

Inside the hood 116 is an inflatable bladder or diaphragm 156 which, in the collapsed position of FIG. 6, lies generally parallel to the upper surface of the forward hood section 148. The bladder 156 includes an inflation tube 158 extending through the hood section 148 to be exposed on the upper surface of the boot receiver. To inflate the bladder 156, a closure 160 is removed from the tube 158 and compressed air is delivered therethrough, preferably with a small bicycle tire type pump. As the bladder 156 moves toward the dashed line position in FIG. 6, it encompasses the skier's footwear, providing support for therefor and also providing a measure of insulation against the cold.

Figure 8:
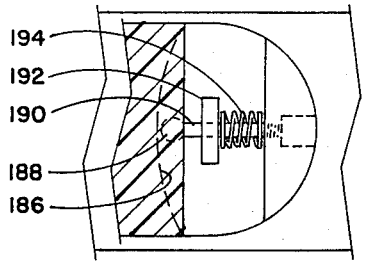
FIG. 8 is a cross-sectional view of the embodiment of FIG. 7, taken substantially .along line 8—8, as viewed in the direction indicated by the arrows.
Figure 7:
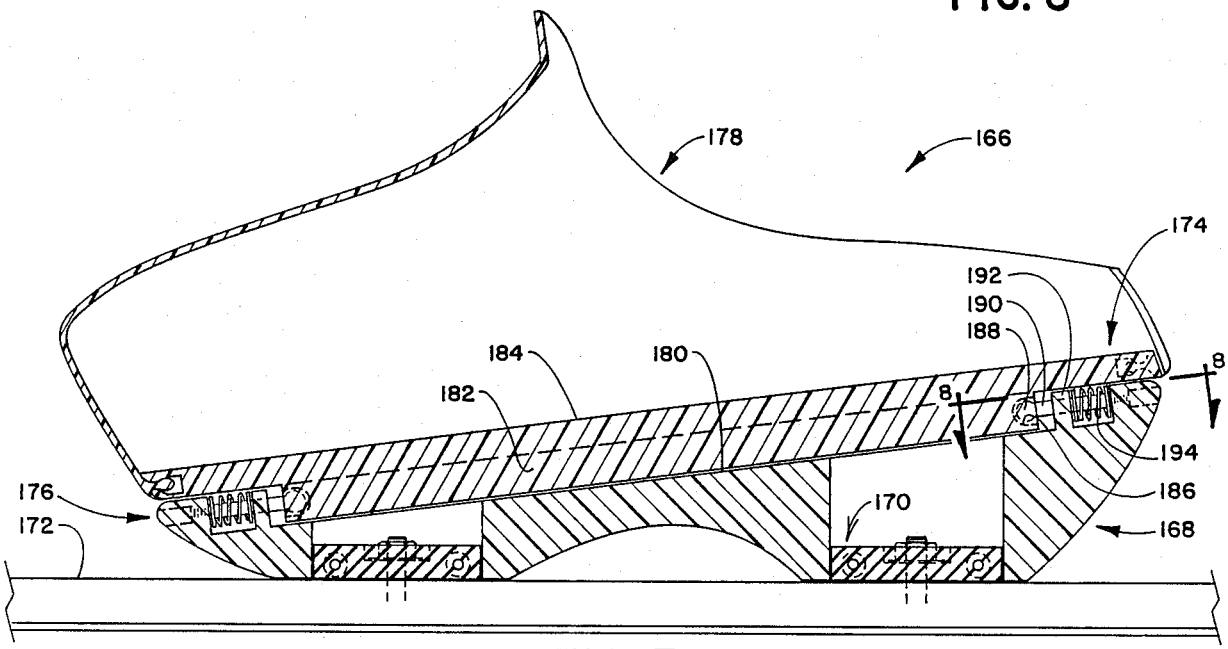
FIG. 7 is an enlarged longitudinal cross-sectional view of yet another embodiment of a rear boot receiver of this invention.

Referring to FIGS. 7 and 8, there is illustrated another embodiment of this invention. A boot receiver 166 is illustrated as including a tapered section 168, means 170 securing the tapered section 168 to a ski 172 behind a more-or-less conventional ski binding (not shown), a platform 174, means 176 securing the platform 174 to the tapered section 168 and a hood 178. The tapered section 168, except for the connecting means 176, is substantially the same as in the embodiment of FIGS. 3–5 and the securing means 170 is substantially the same as the securing means 30.

The tapered section 168 provides a central elongate recess 180 receiving a rail 182 of the platform 174 which also includes a generally planar upper surface 184 for supportably receiving the footwear of the skier. The forward and rearward ends of the rail 182 provide outwardly concave surfaces 186, 188 receiving a ball detent 190 of the securing means 176. The securing means 176 is designed to hold the rail 182 and thus the platform 174 on the tapered section 168 until a predetermined force is applied therebetween. At forces below the predetermined force, the rail 182 is capable of arcuate movement relative to the tapered section 168 in the plane of the rail 182. At forces above the predetermined force, the securing means releases the rail 182, either in the plane of the rail 182 or by allowing the rail to rotate upwardly away from the tapered section 168.

To these ends, the securing means 176 comprises the ball detent 188 having a stem 190 passing through a guide 192 provided by the tapered section 168 and a sprig 194 forcing the ball detent 188 toward engagement with the arcuate surface 186. So long as the separating force applied between the platform 174 and the tapered section 168 is below the predetermined force, the platform 174 is held in place by the securing means 176. Thus, the securing means 176 acts much like a ski binding mechanism and releases the platform 174 in the event of a serious fall. This safety feature is redundant in the sense that the skier's foot is always free to leave the boot receiver 166 through the rear of the hood 178 which may be substantially identical to the hood 36 in the embodiment of FIGS. 3–5.

Figure 1:
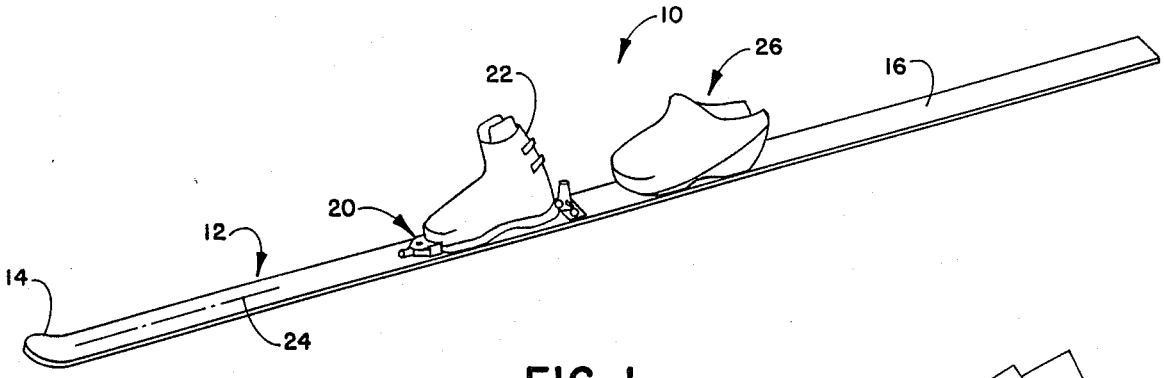
FIG. 1 is an isometric view of a monoski of this invention.
Figure 9:
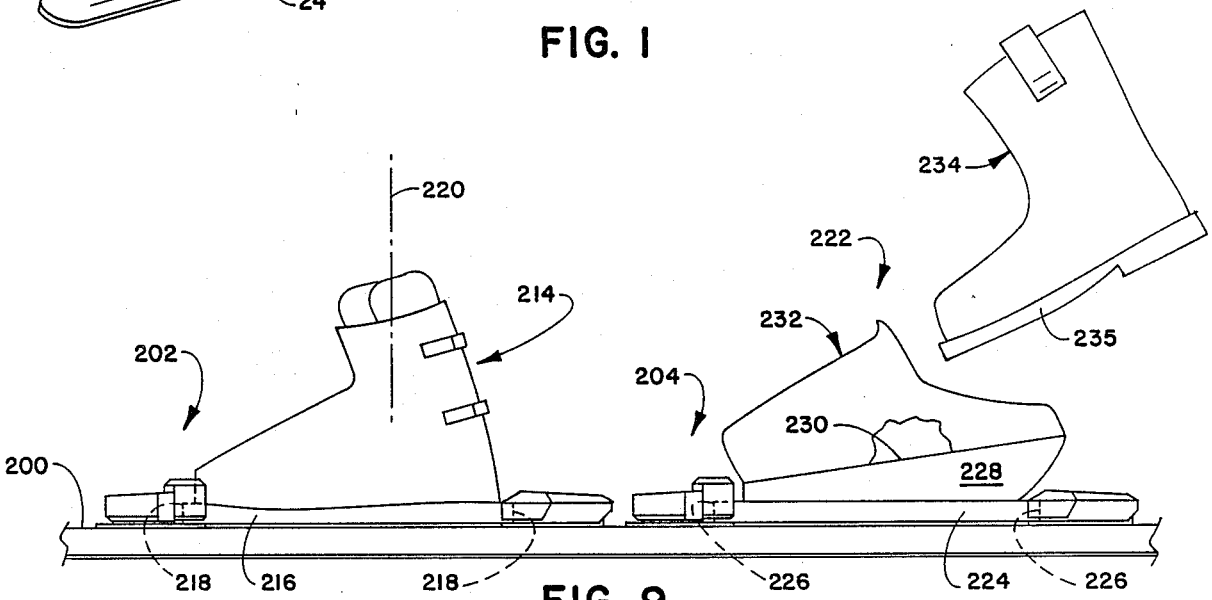
FIG. 9 is a side elevational view of another embodiment of this invention.

Referring to FIG. 9, there is illustrated another technique of this invention where a single ski 200 has secured thereto a forward conventional boot binding assembly 202 and a rearward conventional boot binding assembly 204, each comprising toe bindings 206, 208 and heel bindings 210, 212. Received in the forward binding assembly 202 is a conventional ski boot 214. As used herein, a conventional ski boot 214 has two mandatory characteristics—it includes a substantially rigid sole plate 216 having means 218 thereon for connection with the binding assembly 202. In addition, the conventional ski boot 214 usually acts to position the lower leg of the skier forwardly of a vertical plane 220.

Received in the rearward boot binding assembly 204 is a boot receiver 222 of this invention comprising a rail 224 having means 226 thereon for connection to the binding assembly 204. It will accordingly be seen that the rail 224 is substantially identical to the rigid sole plate 216 of the conventional ski boot 214. The boot receiver 222 also includes a tapered section 228 rigidly secured to the rail 224, a platform 230 rigidly secured to the tapered section 228 and a hood 232 for receiving the footwear of the skier. It will be seen that the approach of FIG. 9 allows snow skiing with a single ski in a conventional manner, using boot bindings for both feet, and with the technique of this invention, allowing the rear foot to be easily removed from connection with the ski, so that stopping and starting are much easier.

Another feature of the invention is illustrated in FIG. 9. So far as is known, snow skiing of all types, either conventionally with a pair of skis or with a monoski of some variety, has been done wearing two conventional ski boots. With the boot receivers of this invention, it is preferred that the rear boot 234 be a non-ski boot, which is here defined as footwear which comprises a relatively flexible sole free from connections for attachment to a ski binding. As is evident, the boot 234 may be of the Wellington type.

Referring to FIG. 10, there is illustrated a ski 236 especially designed for use with monoski boot receivers of this invention. As in the standard modern snow ski 12 of FIG. 2, the ski 236 exhibits considerable camber, which means that in an unloaded condition, the central part of the ski is elevated with respect to the ends. When load is applied to the skis 12, 236, the skis 12, 236 flatten out to conform to the general shape of the underlying surface. In the standard modern snow ski 12 of FIG. 2, the boot binding area 18 is of increased thickness to accommodate threaded fasteners and the like. The front and rear ends 14, 16 are much thinner, are much more flexible and lack the central rib of skis of older design. The boot binding area 18 can be determined because it is on the order of at least $2\frac{1}{2}$–3 times thicker than the thinnest portion of the ski 12, which typically occurs adjacent the extreme front and/or rear of the ski 12. Thus, a modern ski 12 might have a minimum thickness of $\frac{1}{4}''$ and a binding area thickness of almost $\frac{3}{4}''$. In modern skis, there is no well defined transition zone between the boot binding area 18 and the front and rear portions 14, 16 because the skis typically taper gradually from the binding area 18 to the thinnest portion of the ski. In standard snow skis, the boot binding area 18 lies in the range of about 25–30% of the total length of the ski 12. Thus, in a conventional 200 centimeter snow ski, the boot binding area 18 would be about 20" long. In shorter conventional skis, the boot binding area 18 would be shorter and, in a 150 centimeter ski, would be about 16".

In contrast as shown in FIG. 10, the ski 236 of this invention has a much longer boot binding areas 238, i.e. that central part of the ski 236 which is thicker in order to accommodate threaded fasteners and the like. In skis 236 of this invention, the boot binding area 238 is at least on the order of about 45% of the total length of the ski and preferably is at least 55% of the total length. The ski 236 also includes, of course, a forward portion 240 terminating in an upturned end 242 and a rear end 244. The forward and rear ends 238, 242 are much thinner than the boot binding area 234 and consequently are much more flexible. As in most modern skis, there is no well defined transition zone from the relatively thick binding area 238 to the relatively thin forward and rear ends because the ski 236 is usually tapers gradually and more-or-less consistently.

As with the conventional ski 12, the boot binding area 238 of the ski 236 is substantially thicker, on the order of at least 2½–3times, than the thinnest portion of the ski 236 adjacent the extreme forward and rearward ends and accordingly is readily recognized.

It will be evident that the embodiments of FIGS. 3–5, 6, 7–8, 9 are, or may be, mounted on the ski of FIG. 10.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A monoski system for skiing on snow comprising
a ski having forward and rearward ends;
a ski boot binding assembly secured to the ski between the ends and having means for attaching a ski boot to the ski and for releasing the ski boot in response to the application of a predetermined force between the ski boot and the ski; and
a boot receiver including
a platform at least as long as booted human foot for receiving a skier's foot thereon;
a rigid tapered section having an upper section receiving the platform thereon, a relatively thin forward end and a relatively thick rear end for supporting a skier's rear foot in an inclined position;
means for securing the tapered section to the ski rearwardly of the ski boot binding comprising an elastomeric connection allowing limited relative movement between the ski and the tapered section, the elastomeric section comprises a block of elastomeric material, a first connector extending through the block into the ski along a path generally perpendicular to the ski and a second connector carried by the tapered section extending into the block transverse to the first connector; and
means for securing the tapered section to the platform.

2. The monoski system of claim 1 wherein the elastomeric connection comprises a third connector carried by the tapered section extending into the block transverse to the first connector, the second and third connectors being spaced axially along the ski on opposite sides of the first connector.

3. A monoski system for skiing on snow comprising
a ski having forward and rearward ends;
a ski boot binding assembly secured to the ski between the ends and having means for attaching a ski boot to the ski and for releasing the ski boot in response to the application of a predetermined force between the ski boot and the ski; and
a boot receiver including
a platform at least as long as booted human foot for receiving a skier's foot thereon;
a rigid tapered section having an upper section receiving the platform thereon, a relatively thin forward end and a relatively thick rear for supporting a skier's rear foot in an inclined position;
means for securing the tapered section to the rear rearwardly of the ski boot binding; and
means for securing the tapered section to the platform comprising means for adjustably mounting the platform on the tapered section for movement about an upright axis.

4. The monoski system of claim 3 wherein the adjustably mounting means comprises means for adjusting the platform relative to the tapered section throughout a range of angular movement and means for securing the platform to the tapered section in a plurality of positions in the range.

5. The monoski system of claim 4 wherein the platform and the tapered section provide therebetween a plurality of arcuate slot-aperture arrangements and a like plurality of upright threaded fasteners extending through the slot-aperture arrangements.

6. A monoski system for skiing on snow comprising
a ski having forward and rearward ends;
a ski boot binding assembly secured to the ski between the ends and having means for attaching a ski boot to the ski and for releasing the ski boot in response to the application of a predetermined force between the ski boot and the ski; and
a boot receiver including
a platform at least as long as a booted human foot for receiving a skier's foot thereon;
a rigid tapered section having an upper section receiving the platform thereon, a relatively thin forward end and a relatively thick rear end for supporting a skier's rear foot in an inclined position;
means for securing the tapered section to the ski rearwardly of the ski boot binding; and
means for securing the tapered section to the platform; and
a hood extending above and enclosing a forward portion of the platform from the forward end of the platform to a location intermediate the ends of the platform for receiving the skier's foot therebetween.

7. A monoski system for skiing on snow comprising
a ski having forward and rearward ends;
a ski boot binding assembly secured tot he ski between the ends and having means for attaching a ski boot to the ski and for releasing the ski boot in response to the application of a predetermined force between the ski boot and the ski; and a boot receiver including a platform at least as long as a booted human foot for receiving a skier's foot thereon;

a rigid tapered section having an upper section receiving the platform thereon, a relatively thin forward end and a relatively thick rear end for supporting a skier's rear foot in an inclined position;

means for securing the tapered section to the ski rearwardly of the ski boot binding;

means for securing the tapered section to the platform; and a hood extending above a forward portion of the platform for receiving the skier's foot therebetween wherein the hood comprises means for releasably attaching the hood to the platform, the releasably attaching means comprises a series of first connectors carried by the platform and a series of second connectors carried by the hood and capable of mating with the first connectors, the first and second connectors being secured together.

8. The monoski system of claim 7 wherein the first connectors comprise a series of peripherally spaced apertures and the second connectors comprise a series of peripherally spaced protuberances received in the apertures, the releasably attaching means comprising the apertures and the protuberances.

9. A monoski system for skiing on snow comprising a ski having forward and rearward ends;

a ski boot binding assembly secured to the ski between the ends and having means for attaching a ski boot to the ski and for releasing the ski boot in response to the application of a predetermined force between the ski boot and the ski; and a boot receiver including a platform at least as long as a booted human foot for receiving a skier's foot thereon;

a rigid tapered section having an upper section receiving the platform thereon, a relatively thin forward end and a relatively thick rear end for supporting a skier's rear foot in an inclined position, the tapered section comprising a generally planar upper surface and a plurality of partitions extending from the upper surface toward the ski, the partitions defining a plurality of cavities on the bottom of the tapered section;

means for securing the tapered section to the ski located in said plurality of cavities rearwardly of the ski boot binding; and means for securing the tapered section to the platform.

10. A monoski system for skiing on snow comprising a single ski having a forward end and a rearward end;

a ski boot binding secured to the ski between the forward and rearward ends and having means for attaching a ski boot to the ski to position the ski boot on a longitudinal axis of the ski and pointed in the direction of intended travel and for releasing the ski boot in response to the application of a predetermined force between the ski boot and the ski; and a boot receiver carried by the ski rearwardly of the ski boot binding and including a platform for receiving a skier's foot thereon;

a tapered section having a relatively thin forward section and a relatively thick rearward section and a top for receiving and supporting the platform on the ski; and means for mounting the platform on the top of the tapered section relative to the ski for adjusting movement about an upright axis.

11. The monoski system of claim 10 wherein the mounting means comprises means for adjusting the platform relative to the ski throughout a range of angular movement and means for securing the platform in a plurality of positions in the range.

12. The monoski system of claim 11 wherein the platform and the tapered section provide therebetween a plurality of arcuate slot-aperture arrangements and a like plurality of upright threaded fasteners extending through the slot-aperture arrangements.

* * * * *